US005356127A

United States Patent [19]

Moore et al.

[11] Patent Number: 5,356,127

[45] Date of Patent: Oct. 18, 1994

[54] SELF ADJUSTING VACUUM CORRUGATED FEEDER AND METHOD OF FEEDING A SHEET

[75] Inventors: Steven R. Moore, Rochester; Michael J. Martin, Hamlin; Russel J. Sokac, Rochester, all of N.Y.

[73] Assignee: Xerox Corporation, Stamford, Conn.

[21] Appl. No.: 983,924

[22] Filed: Dec. 1, 1992

[51] Int. Cl.[5] ..... B65H 5/08

[52] U.S. Cl. ..... 271/11; 271/96; 271/98; 271/104; 271/265; 271/171

[58] Field of Search ..... 271/11, 12, 90, 96, 271/104, 106, 265, 97, 98, 171

[56] References Cited

U.S. PATENT DOCUMENTS

| | | | |
|---|---|---|---|
| 4,391,439 | 7/1983 | Edstrom | 271/90 |
| 4,518,159 | 5/1985 | Nishibori et al. | 271/106 X |
| 4,566,683 | 1/1986 | Moore | 271/98 |
| 4,638,986 | 1/1987 | Huggins et al. | 271/98 |
| 4,936,566 | 6/1990 | Hiramatsu | 271/90 |
| 5,127,645 | 7/1992 | Torisawa | 271/106 X |
| 5,137,268 | 8/1992 | Suta et al. | 271/106 X |
| 5,181,706 | 1/1993 | Yamamoto et al. | 271/98 X |

FOREIGN PATENT DOCUMENTS

| | | | |
|---|---|---|---|
| 156947 | 9/1982 | Japan | 271/96 |
| 187137 | 7/1989 | Japan | 271/96 |

*Primary Examiner*—Robert P. Olszewski
*Assistant Examiner*—Boris Milef
*Attorney, Agent, or Firm*—Kenyon & Kenyon

[57] ABSTRACT

A device for feeding sheets from a sheet tray which minimizes mis-feeds and multi-feeds. The device includes a device detecting sheet properties such as sheet basis weight and sheet size, a device selecting appropriate air parameters, such as air plenum pressure, plenum flow, and air knife pressure based on the sheet properties detected, and a device adjusting air parameters based on the appropriate air parameters selected.

26 Claims, 6 Drawing Sheets

| BLOWER SPEED | | | | |
|---|---|---|---|---|
| DETECTED BASIS WEIGHT | SHEET SIZE | | | |
| | A6 | A5 | A4 | A3 |
| LIGHTWEIGHT | LOW | LOW | LOW | NOMINAL |
| NOMINAL | LOW | LOW | NOMINAL | NOMINAL |
| HEAVYWEIGHT | NOMINAL | NOMINAL | HIGH | HIGH |

FIG. 2A

| VARIABLE ORIFICE VALVE STATE | | | | |
|---|---|---|---|---|
| DETECTED BASIS WEIGHT | SHEET SIZE | | | |
| | A6 | A5 | A4 | A3 |
| LIGHTWEIGHT | OPEN | OPEN | CLOSED | CLOSED |
| NOMINAL | CLOSED | CLOSED | CLOSED | CLOSED |
| HEAVYWEIGHT | CLOSED | CLOSED | CLOSED | CLOSED |

FIG. 2B

SELF ADJUSTING VACUUM CORRUGATED FEEDER AND METHOD OF FEEDING A SHEET

BACKGROUND OF THE INVENTION

The present invention is related to a top vacuum corrugated feeder (TVCF) and more particularly to a TVCF having air parameters which are self adjusting based on characteristics of sheets in the supply tray.

With the advent of high speed photocopying machines, a document (i.e., sheet) handler to feed sheets to the copy platen of the copier and a copy sheet feeder to feed copy sheets to a transfer station in a rapid dependable manner are needed to realize the full potential copy output of the copier. A number of currently available document handlers and sheet feeders provide such rapid transfer. However, these document handlers and copy sheet feeders are often accompanied by a certain risk of mis-feeds and multi-feeds while maintaining high handling speed. The greatest number of problems occur during the initial separation of the sheet sought to be acquired from the stack of sheets.

To provide a delicate yet positive feed, conventional copying machines employ a vacuum feed belt assembly beneath the stack of copy sheets to be fed for acquiring the bottom sheet in the stack by vacuum, and driving belts to move the acquired sheet from under the stack into the path of sheet movement (see e.g., FIG. 5). To prevent mis-feeds and multi-feeds, an air knife is positioned near the lead edge of the stack for injecting air providing an air bearing between the acquired sheet and the stack. This air bearing greatly reduces the force necessary to pull the bottom sheet from the stack and also minimizes the possibility of the adjacent sheet being pulled out from under the stack with the sheet being fed.

When using the document handler or sheet feeder with a large variation in the size of the document stack placed therein is desired, providing the correct air flow from the air knife may be difficult. For example, with a very small stack of documents, excessive air flow could cause excessive document flutter or, in the extreme, actually blow documents out of the document tray or blow sheets out of the sheet holder. On the other hand, with a large stack of documents the air flow might be insufficient to produce the required separation between the sheets which would result in the increased likelihood of mis-feeds or multi-feeds. Some devices adjust the quantity of air from the air knife based on the weight or pressure of the sheets in the sheet feeder (see e.g., U.S. Pat. No. 4,566,683, incorporated herein by reference) or based on the friction between the bottom two sheets of a stack (see e.g., U.S. Pat. No. 4,638,986, incorporated herein by reference). However, these devices only adjust the air knife and only base that adjustment on characteristics of the stack itself, or the characteristics of sheets with respect to the stack. Further, these adjustments are more suitable for bottom vacuum corrugated feeders than for top vacuum corrugated feeders (TVCFs).

The aforementioned devices fail to further reduce mis-feeds and multi-feeds due to differences in paper size and paper basis weight. In addition, the aforementioned devices only consider one air parameter, i.e., the air knife. In other words, if air parameters are optimized for a paper having a particular basis weight and size, the copier will not perform as well when paper having a different basis weight and/or size is used. Such a copier lacks the flexibility desired by discriminating users. Although air parameters may be chosen that will permit a range of different paper basis weights and paper sizes, these parameters will not afford optimal operation of the sheet feed system. Therefore, while the aforementioned devices may reduce mis-feeds and multi-feeds based on characteristics of the supply stack, they do not optimize performance by adjusting air parameters to accommodate different paper characteristics.

SUMMARY OF THE INVENTION

The present invention overcomes the aforementioned problems in sheet feed systems by further reducing mis-feeds and multi-feeds. The present invention does so by considering inherent characteristics of the copier sheets such as paper size and weight and adjusting one or more air parameters accordingly. This is accomplished by providing a means for detecting sheet properties which includes means for detecting sheet basis weight and means for detecting sheet size.

In a preferred embodiment, the means for detecting sheet basis weight classifies all sheets as either lightweight, normal, or heavyweight. This means for detecting sheet basis weight preferably includes a spring loaded plunger, the displacement of which is a function of the sheet basis weight. A series of switches are arranged adjacent to the plunger assembly to detect this displacement and provide a signal corresponding to the sheet weight.

In a preferred embodiment, the means for detecting sheet size classifies sheets as one of either A3, A4, A5, or A6 and includes a plurality of microswitches provided in the stack tray.

In a preferred embodiment, the means for selecting appropriate air parameters includes a lookup table storing air parameter values for a plurality of particular sheets basis weights and for a plurality of particular sheet sizes. The plurality of particular sheet basis weights includes light, normal, and heavy and the plurality of particular sheet sizes includes A3, A4, A5, and A6.

In a preferred embodiment, the means for adjusting air parameters includes a variable speed blower which preferably includes a brushless DC motor. The means for adjusting air parameters may also include a system of air impedance adjustment which preferably uses at least one adjustable valve and at least one variable orifice valve.

In a preferred embodiment, the means for adjusting air parameters may adjust plenum pressure, plenum flow, and air knife.

BRIEF DESCRIPTION OF THE DRAWING

FIG. 2(*a*) illustrates an example of a lookup table according to the present invention for determining blower speed based on detected sheet size and detected sheet basis weight.

FIG. 2(*b*) illustrates an example of a lookup table according to the present invention for determining the state of a variable orifice valve based on detected sheet size and detected sheet basis weight.

DETAILED DESCRIPTION

Figure 5:
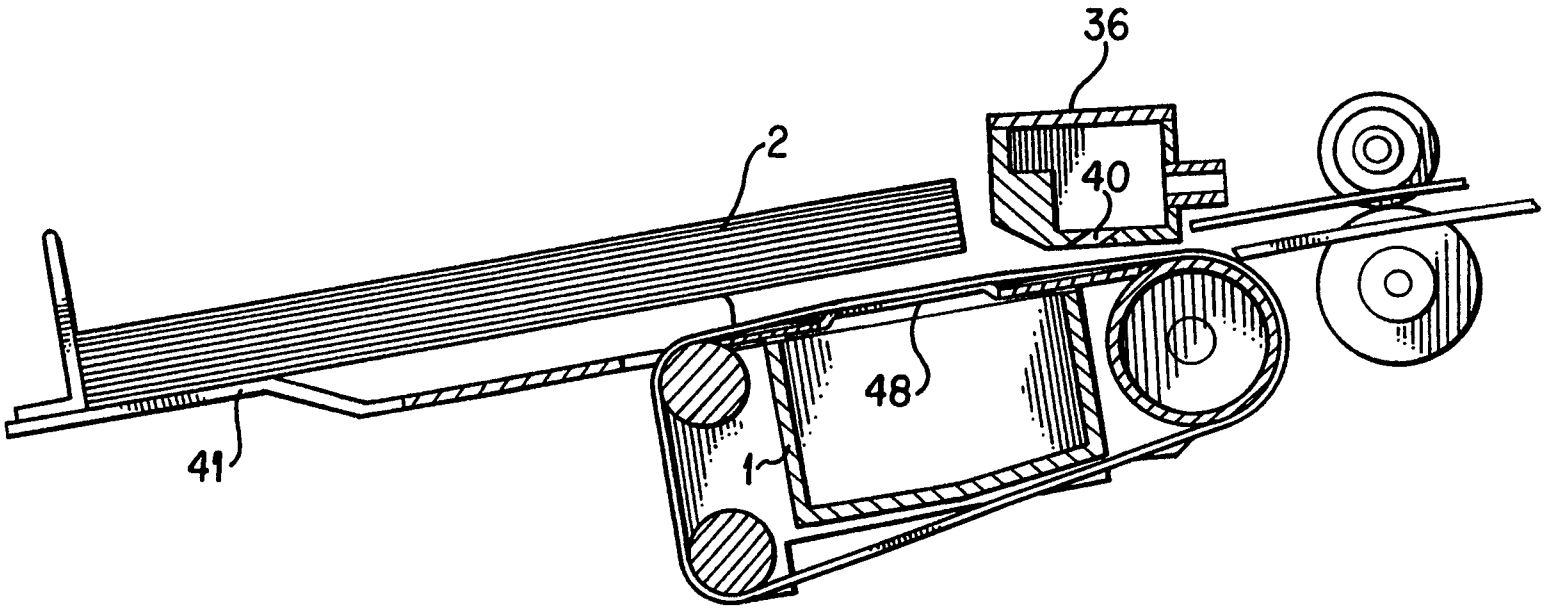
FIG. 5 PRIOR ART
FIG. 5 illustrates, in a side view, a conventional bottom vacuum belt corrugated sheet feeding apparatus.

FIG. 5 illustrates, in a side view, a conventional bottom vacuum belt corrugated sheet feeding (BVCF) apparatus. Although the present invention is directed to a top vacuum belt corrugated sheet feeder, the concepts of its operation are similar to that of a BVCF. In such a conventional sheet feeding apparatus, a stack of sheets 2 is held in a document tray 41. A feeder plenum 1 is located either below (but in a TVCF is located above) the stack 2. The feeder plenum 1 includes a cavity which may be evacuated thereby forming a pressure differential. The ceiling (the floor in a TVCF) of the feeder plenum 1 includes a series of small openings (not shown). The difference in pressure between the inside of the feeder plenum 1 and the outside of the feeder plenum 1 forces the supply paper towards the top (the bottom in a TVCF) outer surface of the feeder plenum 1. A series of feeder belts 3 run along the top (the bottom in a TVCF) surface of the plenum 1 (in a direction normal to the surface of FIG. 1(*a*) or FIG. 6) thereby transferring the acquired sheet held against it.

Figure 7:
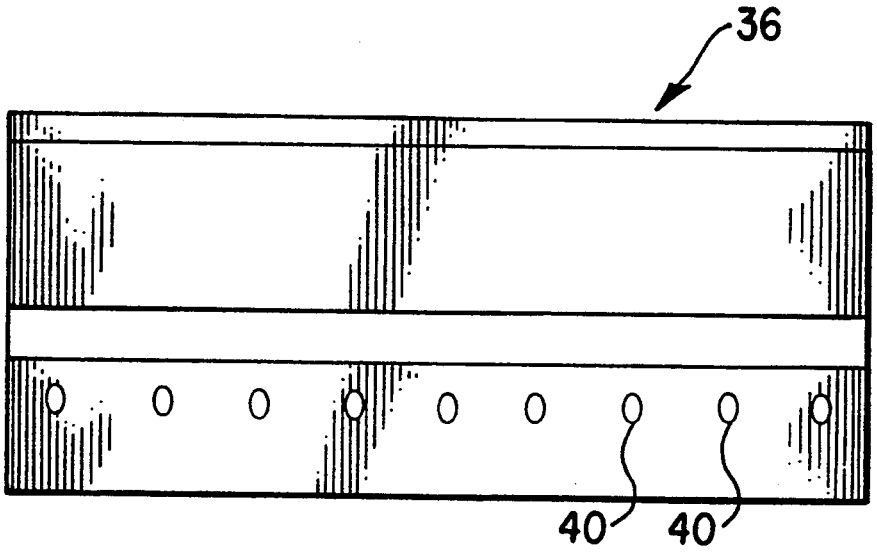
FIG. 7 PRIOR ART
FIG. 7 illustrates, in an end view, the air knife of the conventional sheet feeding apparatus of FIG. 5.

The air knife 36 includes a plurality of air jet openings 40 (see FIG. 7). The air knife 36 is arranged such that it may inject air into the pocket formed between the sheet pulled down (pulled up in a TVCF) against the feed belts 6 and the sheets above it in the stack. Thus, by providing an air cushion or bearing between the stack and the bottom sheet, the force necessary to remove the sheet sought to be acquired from the stack is minimized thereby reducing the likelihood of removing other sheets from the stack (i.e., to reduce multi-feeds).

Figure 6:
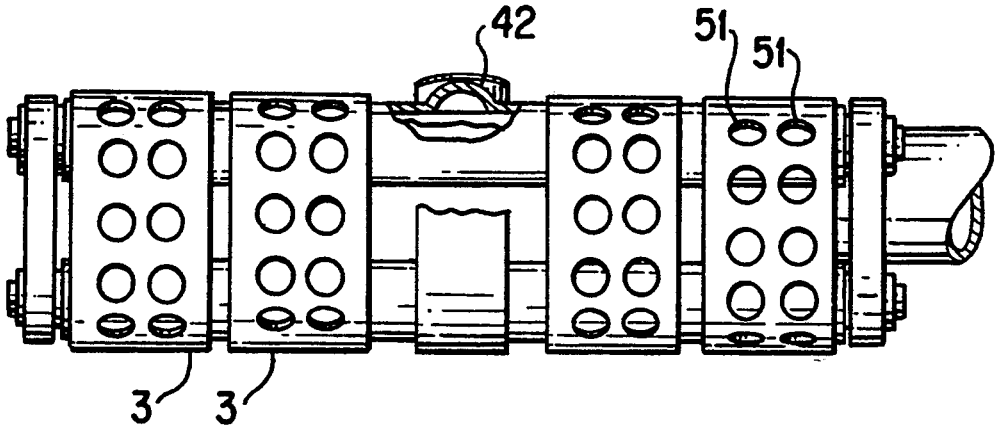
FIG. 6 PRIOR ART
FIG. 6 illustrates, in an end view, the feed belt portion of the conventional sheet feeding apparatus of FIG. 5.

As shown in FIG. 6, the feed belts 3 may include openings 51 which cooperate with openings 42 in the vacuum plenum 1.

As mentioned above, the present invention: (1) detects significant paper properties such as basis weight and size, for example; (2) selects appropriate air parameters such as plenum pressure, plenum flow, and air knife pressure, based on the detected paper properties; and (3) adjusts the air parameters to the values selected.

Figure 1A:
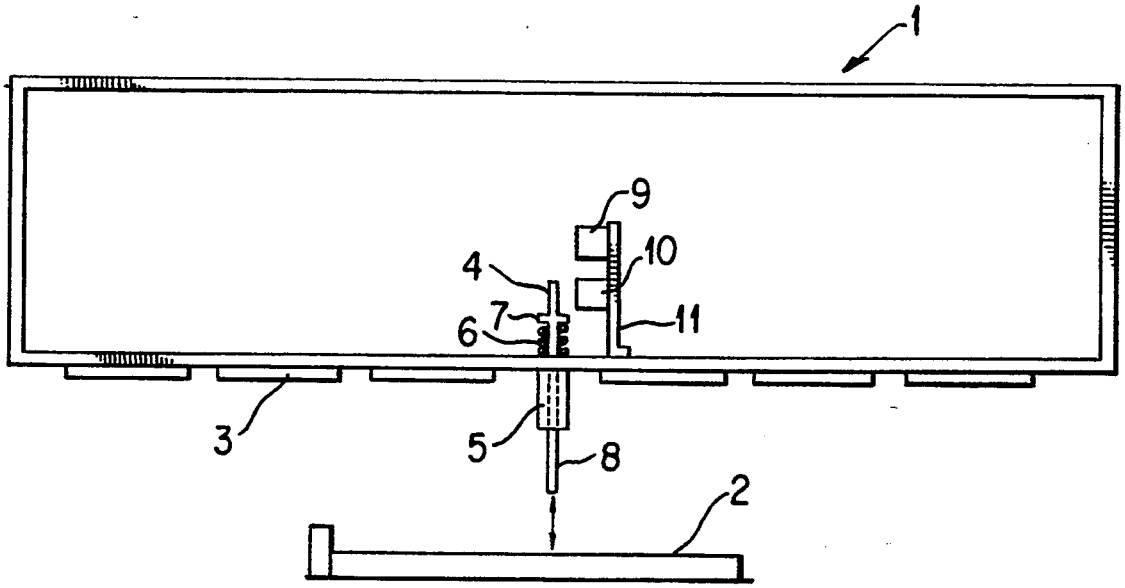
FIGS. 1(*a*) and 1(*b*) illustrate an end-view of a feeder plenum including examples of alternate means for detecting paper basis weight used in the present invention.
Figure 1B:
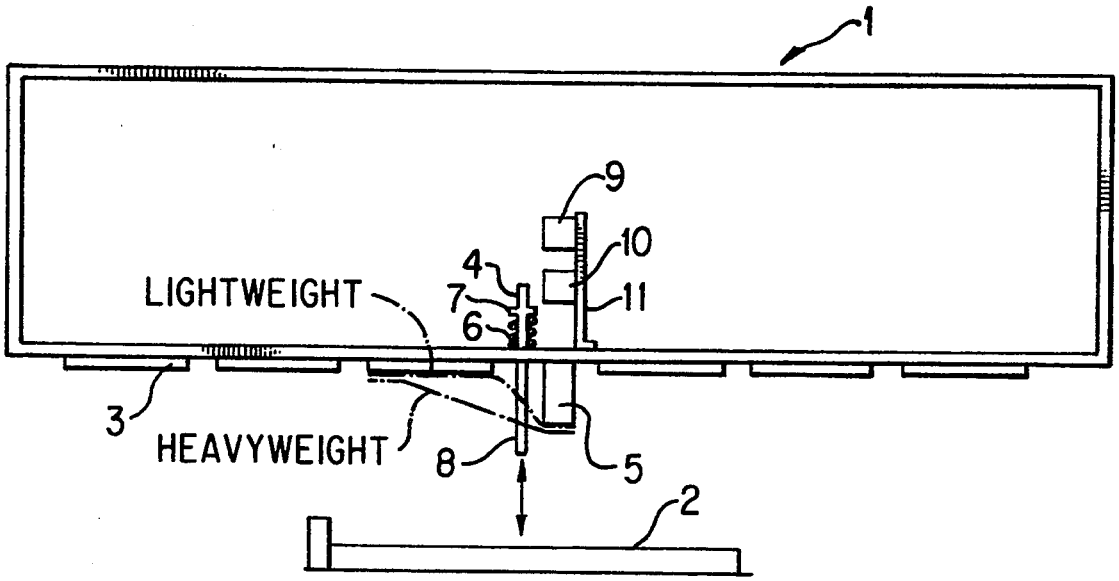

FIG. 1(*a*) illustrates an example of a means for detecting the basis weight of paper. A feeder plenum 1 is located above a stack of supply paper 2 (in FIG. 5, the feeder plenum 1 was located below the stack of supply paper). The feeder plenum 1 includes a cavity which may be evacuated thereby forming a pressure differential. The floor of the feeder plenum 1 includes a series of small openings (not shown). The difference in pressure between the inside of the feeder plenum 1 and the outside of the feeder plenum 1 forces top-most sheet of the supply paper towards the bottom outer surface of the feeder plenum 1. A series of feeder belts 3 run along the bottom surface of the plenum 1 (in a direction normal to the surface of FIG. 1(*a*)) thereby transferring any sheets forced against it.

A spring-loaded plunger 4 is disposed within a feedhead corrugator bar 5. The feedhead corrugator bar 5 changes the geometry of (i.e., bends) the sheet forced against it such that any sheets sticking to the acquired sheet to be fed are more easily separated by the air knife.

Both the spring-loaded plunger 4 and the feedhead corrugator bar 5 are positioned normal to the surface of the floor of the feeder plenum 1 and extend downward toward the stack of supply sheets. A spring 6 is disposed between a ledge 7 of the spring-loaded plunger 4 and the bottom inside surface of the feeder plenum 1 such that a first end of the spring 6 is attached to the ledge 7 of the plunger 4 while a second end of the spring 6 is attached to the bottom inside surface of the feeder plenum 1.

When a sheet of paper is forced toward the bottom surface of the feeder plenum 1 by the pressure differential, the sheet will exert an upward force on the plunger due to the bending of the sheet. Since a relatively heavy weight sheet is stiffer than a normal weight sheet, more force is exerted on the plunger 4 while relatively light weight sheets are more flexible and therefore exert less force on the plunger 4. The plunger is forced upwards against the biasing force of the spring in an amount proportional to the force exerted by the paper. In a preferred embodiment, the plunger is displaced on the order of 5 to 10 mm.

One or more sensors (9, 10) are mounted on a sensor mount (11) such that they can detect the displacement of the plunger. In this embodiment, the sensors are optical sensors having a beam which is broken when the plunger 4 crosses it. In general, n sensors can differentiate n+1 plunger positions. In the embodiment illustrated in FIG. 1(*a*), the two sensors can detect three plunger positions corresponding to three basis weights (see TABLE I).

TABLE I

| | Basis Weight | | |
|---|---|---|---|
| Sensor | Lightweight | Medium Weight | Heavyweight |
| 9 Tripped? | | | |
| 10 Tripped? | | | |

FIG. 1(*b*) illustrates an end-view of a feeder plenum including an alternate means for detecting paper basis weight. In FIG. 1(*b*), the spring-loaded plunger 4 is located between the feedhead corrugated bar 5 and one of the feeder belts 3 rather than being located within the feedhead corrugated bar 5 (as was the case of the embodiment illustrated in FIG. 1(*a*)). In this embodiment, since the lightweight paper is relatively flexible, it will more closely conform to the geometry of the feedhead corrugator bar 5 and will therefore push the plunger 4 higher than a stiffer heavyweight paper. Again, n sensors can differentiate n+1 plunger positions. In the embodiment illustrated in FIG. 1(*b*), the two sensors can detect three plunger positions corresponding to three basis weights (see TABLE II).

TABLE II

| | Basis Weight | | |
|---|---|---|---|
| Sensor | Lightweight | Medium Weight | Heavyweight |
| 9 Tripped? | | | |
| 10 Tripped? | | | |

Figure 8:
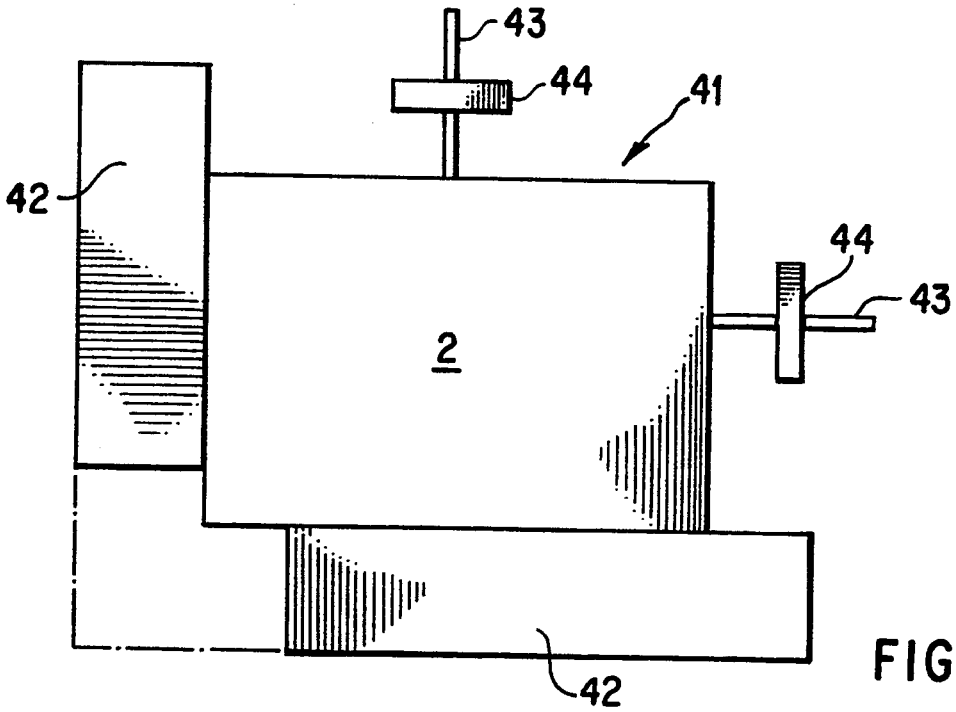
FIG. 8 illustrates, in a top view, a paper tray able to accommodate various paper sizes.

FIG. 8 illustrates, in a top view, a paper tray 4 able to accommodate a number of different paper sizes. The paper tray includes two fixed walls 42. These walls may be connected or detached (as shown by the dashed lines). Two adjacent sides of the paper stack 2 abut the fixed walls 42 of the paper tray 4. Two movable walls 44 are slid along tracks 43 into position so as to abut the remaining two sides of the paper stack 2. Providing microswitches (not shown), the states of which are a function of the position of the movable walls 44, is an example of a means for determining paper size. Providing the supply tray 4 with an array of microswitches (e.g., optical sensors) is another example of a means for determining paper size. For example, paper sizes such as A3, A4, A5, and A6 may be discerned.

FIG. 2(*a*) illustrates an example of a lookup table according to the present invention for determining blower speed based on detected sheet size and detected sheet basis weight while FIG. 2(*b*) illustrates an example of a lookup table according to the present invention for determining the state of a variable orifice valve based on detected sheet size and detected sheet basis weight. The values contained in the lookup table are predetermined through a series of optimization tests for each paper condition, i.e., the values producing the least mis-feeds or multi-feeds for a given paper size and weight may be experimentally predetermined. The lookup tables may be embodied by a ROM including air parameter information, for example. The memory locations of the ROM are addressed based on the sheet size and the detected basis weight. That is, the address word for addressing the ROM may include bits corresponding to the states of the plunger position sensors and the states of the microswitches in the supply tray.

Figure 3:
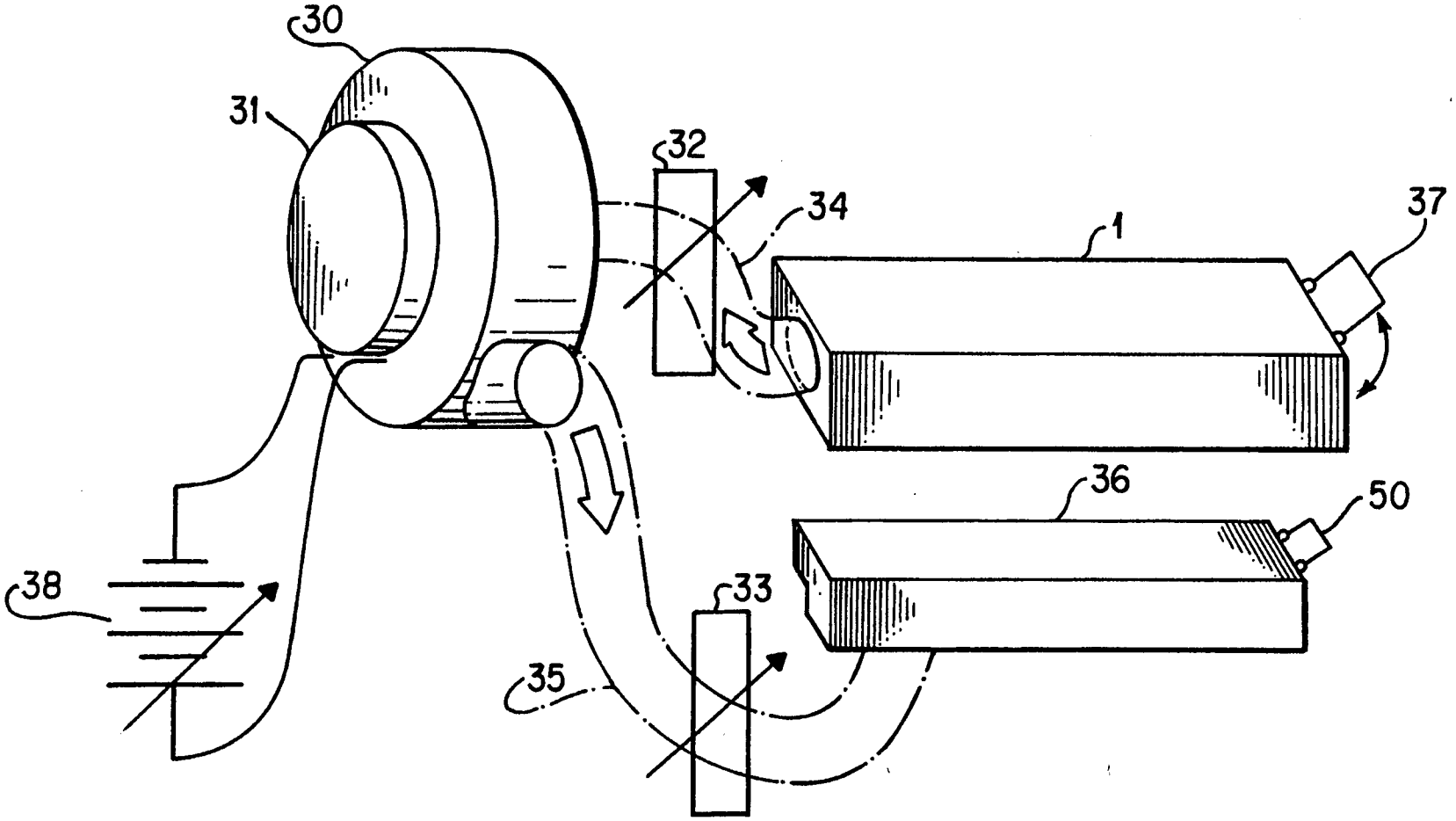
FIG. 3 illustrates an example of a copier apparatus according to the present invention which permits plenum pressure, plenum flow, and the air knife to be adjusted.

FIG. 3 illustrates an example of a copier apparatus according to the present invention which permits plenum pressure, plenum flow, and air knife to be adjusted based on air parameter information accessed. Using a blower 30 driven by a variable speed brushless DC motor 31, for example, the feeder plenum 1 is evacuated via duct 34 while the air knife 36 is provided with air via duct 35. In a preferred embodiment, the blower operates at speeds on the order of 5000 to 7000 rpm.

Figure 4:
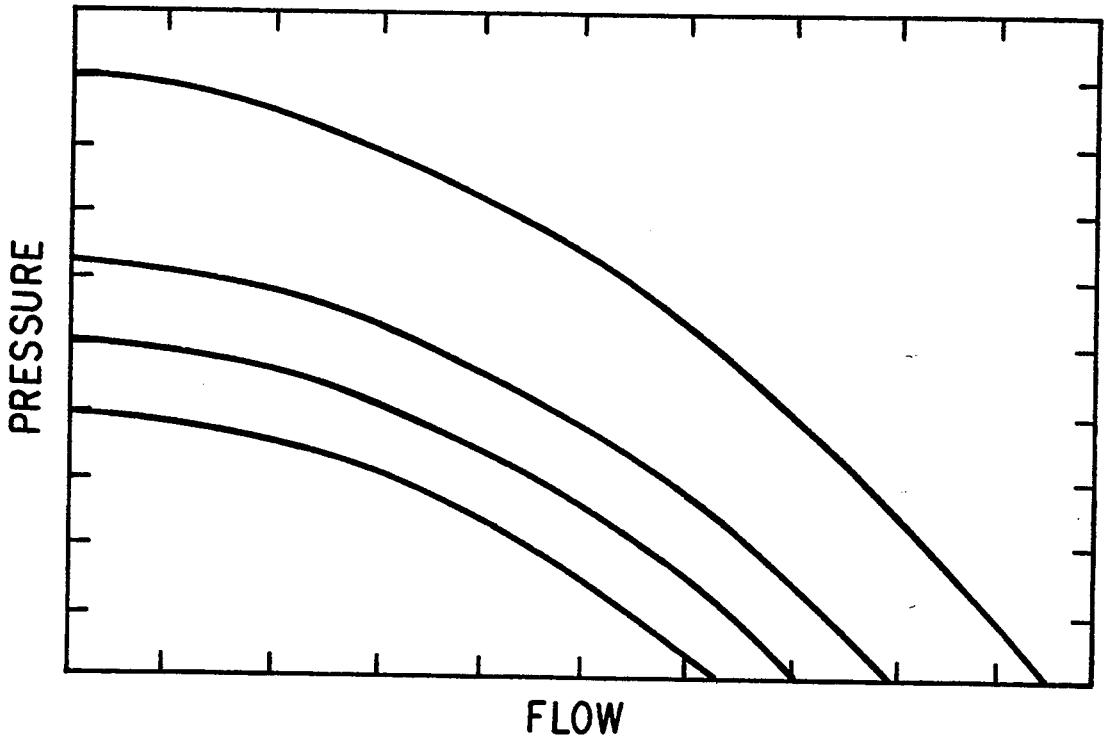
FIG. 4 illustrates the pressure versus flow characteristic of a blower which may be used in the present invention.

The plenum pressure and plenum flow parameters may be changed by one or more of the following: (1) varying the speed of the blower 30 by varying the supply voltage 38; (2) changing the rate of evacuation of the feeder plenum 1 by regulating the adjustable valve 32; and (3) changing, in effect, the volume and contour of the feeder plenum by regulating a variable orifice valve 37 (e.g., a solenoid operated flapper bleeder valve or a butterfly valve). Regarding the first way of changing the plenum pressure and plenum flow, changing the speed of the blower has the effect of shifting the entire blower curve (i.e., pressure versus flow curve) as is illustrated by FIG. 4. In a preferred embodiment, the blower 30 has a "non-flat" blower curve. Regarding the second way of changing the plenum pressure and plenum flow, the adjustable valve 32 affects the impedance of the plenum duct 24. Regarding the third way of changing the plenum pressure and plenum flow, the plenum impedance is varied by varying the opening of the variable orifice valve 37. For example, when a lightweight paper is detected, the variable orifice valve 37 is opened thereby decreasing the plenum pressure differential. On the other hand, when a heavyweight paper is detected, the variable orifice valve 37 is closed thereby increasing the plenum pressure differential. The variable orifice valve may be a bleeder valve or a butterfly valve, for example.

The air knife parameter may be changed by one or more of the following: (1) varying the speed of the blower 30 by varying the supply voltage 38; (2) changing the rate of air flow of the air knife 36 by regulating the adjustable valve 33; and (3) changing the state of the variable orifice valve 50.

The sequence of operation of the document feeder of the present invention is as follows. A stack of paper 2 is placed into the paper tray 41 so as to abut the fixed walls 42 of the paper tray 41. The movable walls 42 are slid along the tracks 43 so as to abut the remaining two side of the paper stack 2. The states of the microswitches provided in the paper tray 41 are determined by the positions of the movable walls 44.

The blower 30 is driven at a pre-determined initial speed by the variable speed brushless DC motor. The blower 30 provides an air knife which creates an air bearing between the sheets in the sheet stack 2. The adjustable valves 32 and 33 and the variable orifice valves 37 and 50 assume a pre-determined initial state. The blower 30 also evacuates the feeder plenum 1. The pressure differential between the cavity of the feeder plenum 1 and the outside forces air from the outside of the feeder plenum through the holes 42 into the plenum cavity. This air flow sucks the top-most sheet of the sheet stack 2 against the bottom outside surface of the feeder plenum. This sheet displaces the spring plunger 4. The states of the switches 9 and 10 are determined by the displacement of the spring plunger 4.

A ROM memory location containing blower speed and valve state information is addressed based on the states of the microswitches in the paper tray 41 and the switches 9 and 10. The addressed data is output and provided to control the speed of the blower 30, the states of the adjustable valves 32 and 33 and the states of the variable orifice valves 37 and 50 such that the air knife, plenum pressure and plenum flow are optimized for the particular properties of the sheets in the sheet stack 2. The feeder belts 3 transfer the acquired sheet to its destination.

Additional advantages and modifications will readily occur to those skilled in the art. Therefore, the present invention, in its broader aspects, is not limited to the specific details, representative apparatus, and illustrative examples shown and described. Accordingly, departures may be made from such details and examples without departing from the spirit of scope of the general inventive concept as defined by the claims and their equivalents.

What is claimed is:

1. In a device for feeding sheets from a stack of sheets held in a sheet tray including an air knife positioned near a top of the stack of sheets and having a first adjustable air parameter, and a vacuum feeder positioned above the stack of sheets and having a second adjustable air parameter, a control device comprising:

a) means for detecting a first sheet property and a second, unrelated, sheet property;

b) means for selecting an appropriate air parameter for at least one of said first adjustable air parameter and said second adjustable air parameter based on the first and second sheet properties detected by said means for detecting; and c) means for adjusting said at least one of said first adjustable air parameter and said second adjustable air parameter based on the appropriate air parameter selected by said means for selecting, whereby misfeeds and multifeeds are minimized.

2. The device for feeding sheets as claimed in claim 1 wherein said means for detecting said first and second sheet properties includes means for detecting sheet size.

3. The device for feeding sheets as claimed in claim 1 wherein said means for adjusting includes a variable speed blower.

4. The device for feeding sheets as claimed in claim 3 wherein said variable speed blower includes a brushless DC motor.

5. The device for feeding sheets as claimed in claim 1 wherein said means for adjusting includes a system of air impedance adjustment.

6. The device for feeding sheets as claimed in claim 5 wherein said system of air impedance adjustment includes an adjustable valve, a relief valve, and a variable orifice valve.

7. The device for feeding sheets as claimed in claim 1 wherein said means for adjusting includes a variable speed blower and a system of air impedance.

8. The device for feeding sheets as claimed in claim 1 wherein the at least one air parameter adjusted by said means for adjusting includes plenum pressure.

9. The device for feeding sheets as claimed in claim 1 wherein the at least one air parameter adjusted by said means for adjusting includes plenum flow.

10. The device for feeding sheets as claimed in claim 1 wherein the at least one air parameter adjusted by said means for adjusting includes air knife pressure.

11. In a device for feeding sheets from a stack of sheets held in a sheet tray including an air knife positioned near a top of the stack of sheets and having a first adjustable air parameter, and a vacuum feeder positioned above the stack of sheets and having a second adjustable air parameter, a control device comprising:

a) means for detecting a sheet property including means for detecting sheet basis weight;

b) means for selecting an appropriate air parameter for at least one of said first adjustable air parameter and said second adjustable air parameter based on the sheet property detected by said means for detecting; and c) means for adjusting said at least one of said first and second adjustable air parameters based on the appropriate air parameter selected by said means for selecting, whereby misfeeds and multifeeds are minimized,

12. In a device for feeding sheets from a stack of sheets held in a sheet tray including an air knife positioned near a top of the stack of sheets and having a first adjustable air parameter, and a vacuum feeder positioned above the stack of sheets and having a second adjustable air parameter, a control device comprising:

a) means for detecting a sheet properties including i) means for detecting sheet basis weight, and ii) means for detecting sheet size;

b) means for selecting an appropriate air parameter for at least one of said first adjustable air parameter and said second adjustable air parameter based on the sheet properties detected by said means for detecting; and c) means for adjusting said at least one of said first and second adjustable air parameters based on the appropriate air parameter selected by said means for selecting, whereby misfeeds and multifeeds are minimized.

13. The device for feeding sheets as claimed in claim 12 wherein said means for detecting sheet basis weight classifies all sheets as either lightweight, normal, or heavyweight.

14. The device for feeding sheets as claimed in claim 12 wherein said means for detecting sheet size classifies all sheets as either A3, A4, A5, or A6.

15. The device for feeding sheets as claimed in claim 12 wherein said means for detecting sheet basis weight includes:

a spring loaded plunger, said spring loaded plunger being displacable by an amount based on the sheet basis weight; and switches, said switches detecting the amount of displacement of said spring loaded plunger, wherein the sheet basis weight is based on the amount of displacement of said spring loaded plunger detected by said switches.

16. The device for feeding sheets as claimed in claim 15 wherein said means for detecting sheet basis weight further includes a corrugated bar, wherein said spring loaded plunger passes through said corrugated bar.

17. The device for feeding sheets as claimed in claim 15 wherein said means for detecting sheet basis weight further includes a corrugated bar located adjacent to a bottom portion of said spring loaded plunger.

18. The device for feeding sheets as claimed in claim 12 wherein said means for detecting sheet size includes a plurality of microswitches, said plurality of microswitches being provided in said tray.

19. The device for feeding sheets as claimed in claim 12 wherein said means for selecting an appropriate air parameter includes a lookup table storing air parameter values for a plurality of particular sheets basis weights and for a plurality of particular sheet sizes.

20. The device for feeding sheets as claimed in claim 19 wherein said plurality of particular sheet basis weights includes lightweight, normal, and heavy.

21. The device for feeding sheets as claimed in claim 19 wherein said plurality of particular sheet sizes includes A3, A4, A5, and A6.

22. In a device for feeding sheets from a stack of sheets held in a sheet tray including an air knife positioned near a top of the stack of sheets and having a first adjustable air parameter, and a vacuum feeder positioned above the stack of sheets and having a second adjustable air parameter, a method for controlling at least one of said first and second adjustable parameters to minimize misfeeds and multifeeds comprising the steps of:

a) detecting first and second sheet properties;

b) selecting an appropriate air parameter for at least one of said first and second adjustable air parameters based on said first and second sheet properties detected in step (a); and c) adjusting said at least one of said first and second adjustable air parameters based on the appropriate air parameter selected in step (b).

23. A device for feeding sheets from a stack of sheets held in a sheet tray comprising:

a) an air knife, said air knife i) positioned near a top of said stack of sheets, and ii) having a first adjustable air parameter;

b) a vacuum feeder, said vacuum feeder i) positioned above said stack of sheets, and ii) having a second adjustable air parameter;

c) a detector adapted to detect a first sheet property and a second, unrelated, sheet property of a sheet in said stack of sheets;

d) a selector adapted to select an appropriate air parameter for at least one of said first and second adjustable air parameters based on said first and second sheet properties; and e) an air parameter adjustment device adapted to adjust said at least one of said first and second adjustable air parameters based on said appropriate air parameter, whereby misfeeds and multifeeds are minimized.

24. The device for feeding sheets as claimed in claim 23 wherein said detector is adapted to detect sheet size.

25. A device for feeding sheets from a stack of sheets held in a sheet tray comprising:

a) an air knife, said air knife
   i) positioned near a top of said stack of sheets, and
   ii) having a first adjustable air parameter;

b) a vacuum feeder, said vacuum feeder
   i) positioned above said stack of sheets, and
   ii) having a second adjustable air parameter;

c) a detector adapted to detect sheet basis weight of a sheet in said stack of sheets;

d) a selector adapted to select an appropriate air parameter for at least one of said first and second adjustable air parameters based on said detected sheet basis weight; and e) an air parameter adjustment device adapted to adjust said at least one of said first and second adjustable air parameters based on said appropriate air parameter, whereby misfeeds and multifeeds are minimized.

26. A device for feeding sheets from a stack of sheets held in a sheet tray comprising:

a) an air knife, said air knife
   i) positioned near a top of said stack of sheets, and
   ii) having a first adjustable air parameter;

b) a vacuum feeder, said vacuum feeder
   i) positioned above said stack of sheets, and
   ii) having a second adjustable air parameter;

c) a detector adapted to detect both sheet size and sheet basis weight of a sheet in said stack of sheets;

d) a selector adapted to select an appropriate air parameter for at least one of said first and second adjustable air parameters based on said detected sheet size and sheet basis weight; and e) an air parameter adjustment device adapted to adjust said at least one of said first and second adjustable air parameters based on said appropriate air parameter, whereby misfeeds and multifeeds are minimized.

* * * * *

UNITED STATES PATENT AND TRADEMARK OFFICE

CERTIFICATE OF CORRECTION

PATENT NO. : 5,356,127

DATED : October 18, 1994

INVENTOR(S) : Steven R. Moore, et al

It is certified that error appears in the above-indentified patent and that said Letters Patent is hereby corrected as shown below:

| Column | Line | |
|---|---|---|
| 4 | 40-45 | Correct "TABLE I" to read as follows: |

TABLE I

| Sensor | Basis Weight | | |
|---|---|---|---|
| | Lightweight | Medium Weight | Heavyweight |
| 9 Tripped? | | | ✓ |
| 10 Tripped? | | ✓ | ✓ |

UNITED STATES PATENT AND TRADEMARK OFFICE

CERTIFICATE OF CORRECTION

PATENT NO. : 5,356,127

DATED : October 18, 1994

INVENTOR(S) : Steven R. Moore, et al

It is certified that error appears in the above-indentified patent and that said Letters Patent is hereby corrected as shown below:

| Column | Line | |
|---|---|---|
| 4 | 62-67 | Correct "TABLE II" to read as follows: |

TABLE II

| Sensor | Basis Weight | | |
|---|---|---|---|
| | Lightweight | Medium Weight | Heavyweight |
| 9 Tripped? | ✓ | | |
| 10 Tripped? | ✓ | ✓ | |

Signed and Sealed this

Fourteenth Day of March, 1995

*Attest:*

Bruce Lehman

BRUCE LEHMAN

*Attesting Officer*

*Commissioner of Patents and Trademarks*